US007725993B1

(12) United States Patent
Giampavolo

(10) Patent No.: US 7,725,993 B1
(45) Date of Patent: Jun. 1, 2010

(54) SAFETY BUCKLE WITH PASSIVE CATCH

(76) Inventor: Paul Giampavolo, 6 Kingsbridge Rd., Fairfield, NJ (US) 07004

( * ) Notice: Subject to any disclaimer, the term of this patent is extended or adjusted under 35 U.S.C. 154(b) by 0 days.

(21) Appl. No.: 11/205,295

(22) Filed: Aug. 15, 2005

Related U.S. Application Data

(63) Continuation-in-part of application No. 11/090,696, filed on Mar. 25, 2005, now Pat. No. 7,513,020, which is a continuation-in-part of application No. 10/811,168, filed on Mar. 26, 2004, now Pat. No. 7,559,126.

(60) Provisional application No. 60/641,346, filed on Jan. 4, 2005.

(51) Int. Cl.
*A44B 11/25* (2006.01)
*A44B 11/26* (2006.01)

(52) U.S. Cl. ..... 24/615; 24/614; 24/625; 24/662

(58) Field of Classification Search ..... 24/614, 24/615, 625, 662
See application file for complete search history.

(56) References Cited

U.S. PATENT DOCUMENTS

| | | | | | |
|---|---|---|---|---|---|
| 4,458,392 | A | | 7/1984 | Pogharian et al. | 24/664 |
| 4,712,280 | A | | 12/1987 | Fildan | 24/625 |
| 4,881,492 | A | * | 11/1989 | Jones | 119/865 |
| 5,027,477 | A | * | 7/1991 | Seron | 119/865 |
| 5,263,726 | A | | 11/1993 | Wood | 280/33.992 |
| 5,291,641 | A | * | 3/1994 | Morino | 24/625 |
| 5,322,037 | A | * | 6/1994 | Tozawa | 119/865 |
| D359,464 | S | | 6/1995 | Grasso et al. | D11/216 |
| 5,443,039 | A | * | 8/1995 | Suchowski | 119/865 |
| 5,465,472 | A | | 11/1995 | Matoba | 24/625 |
| 5,584,105 | A | * | 12/1996 | Krauss | 24/614 |
| 5,659,931 | A | | 8/1997 | Anscher | 24/614 |
| 5,774,956 | A | | 7/1998 | French et al. | 24/625 |
| 5,855,057 | A | | 1/1999 | Anscher | 24/614 |
| 5,974,639 | A | * | 11/1999 | Keller | 24/662 |
| 5,991,985 | A | | 11/1999 | Galbreath | 24/625 |
| 6,000,109 | A | | 12/1999 | Anscher | 24/614 |
| 6,073,317 | A | * | 6/2000 | Barison | 24/115 F |
| 6,138,330 | A | | 10/2000 | Galbreath | 24/625 |
| 6,163,942 | A | * | 12/2000 | Liao | 24/625 |
| 6,311,374 | B1 | | 11/2001 | Anscher | 24/625 |
| 6,351,876 | B1 | * | 3/2002 | Uehara | 24/625 |
| 6,446,314 | B1 | | 9/2002 | Anscher | 24/614 |
| 6,539,588 | B1 | * | 4/2003 | Brosofsky et al. | 24/3.4 |

(Continued)

FOREIGN PATENT DOCUMENTS

| | | |
|---|---|---|
| EP | 0 348 075 A1 | 12/1989 |

(Continued)

*Primary Examiner*—Robert J Sandy
(74) *Attorney, Agent, or Firm*—Weingarten, Schurgin, Gagnebin & Lebovici LLP

(57) ABSTRACT

A passive latch provided in a clasped buckle provides a clasping action with no active release. The passive latch is disengaged when the buckle parts are separated through application of a separation force. The separation force can be provided in part by a component of a pinching force applied to another latch mechanism to release the other latch mechanism. The buckle may include other child resistant features, and can be composed of impact modified nylon to resist loss of tolerances or deformation to contribute to maintaining the child resistant features.

19 Claims, 8 Drawing Sheets

U.S. PATENT DOCUMENTS

| | | | | |
|---|---|---|---|---|
| 6,662,414 | B1 | 12/2003 | Niewiadomski | 264/625 |
| 6,684,466 | B2 | 2/2004 | Nishida et al. | 24/615 |
| 6,728,999 | B2 | 5/2004 | Murai et al. | 24/615 |
| 6,826,806 | B2 * | 12/2004 | Eaton et al. | 24/115 F |
| 6,948,220 | B2 * | 9/2005 | Chen | 24/602 |
| 7,107,941 | B2 * | 9/2006 | Wang | 119/865 |

FOREIGN PATENT DOCUMENTS

| | | | | | |
|---|---|---|---|---|---|
| GB | 2 150 632 | A | | 7/1985 | |
| JP | 07051106 | A | | 2/1995 | |
| JP | 08-84610 | | | 4/1996 | |
| JP | 2001061514 | A | * | 3/2001 | 24/614 |
| WO | WO 84/01275 | | | 4/1984 | |

* cited by examiner

SAFETY BUCKLE WITH PASSIVE CATCH

RELATED APPLICATIONS

This application is a continuation in part application of U.S. application Ser. No. 11/090,696, filed Mar. 25, 2005, now U.S. Pat. No. 7,513,020 entitled Safety Buckle with Multiple Orientation Clasp, which claims the benefit of U.S. provisional application No. 60/641,346 filed Jan. 4, 2005, and which is a continuation in part application of application Ser. No. 10/811,168, filed Mar. 26, 2004, now U.S. Pat. No. 7,559,126 entitled Safety Buckle with Multiple Orientation Clasp.

STATEMENT REGARDING FEDERALLY SPONSORED RESEARCH OR DEVELOPMENT

N/A

BACKGROUND OF THE INVENTION

1. Field of the Invention

The present invention relates generally to safety buckles used with a strap, and relates more particularly to child resistant safety buckles for securing a child in a seat.

2. Description of the Related Art

Child resistant safety buckles are used in a number of applications including securing children in strollers, high chairs and shopping carts. Child restraint safety buckles contribute to securing a child in a seat to prevent the child from being free and thus avoid situations in which the child might be in danger or injured. A particular type of safety buckle is child resistant, to prevent children under a given age from releasing the buckle and freeing themselves. Although children under a certain age are prevented from unclasping the buckle, adults typically have no difficulty in disengaging the buckle to free the child. One type of buckle that is child resistant but can be opened by an adult has a double action feature to permit the buckle to be opened. That is, the buckle is opened by operating several disengaging elements to unlatch the buckle and disengage the buckle portions. By providing two actions to allow the buckle to be opened, the buckle is made child resistant, because a typical child under a certain age is unable to properly operate the two features, either sequentially or at the same time, for example, to unlatch and open the buckle. At the same time, an adult can easily and intuitively disengage the buckle by operating the two features as required.

A number of buckles are available that, while not designed to be child resistant, have security features, so that the buckles will not disengage unexpectedly. These types of buckles also have a multi-open feature, in that a number of operations must be conducted on the buckle to permit the buckle to be unlatched and opened. Typical applications for these types of buckles involve heavy duty or industrial uses, such as clasps for utility belts, sportswear or other applications where the buckle is subjected to high loading or must be well secured.

One such high security buckle is shown in U.S. Pat. No. 5,774,956 to French et al., which discloses a buckle with flexible side release latches and a third latch accessible on the front of the buckle. The male portion of the buckle includes a central latch arm that engages the female portion of the buckle in a central portion, and is released by pressing on a central button on one side of the female buckle portion. The buckle unlatches when both side latch arms are moved inwardly, and the central arm is moved away from the catch on the female portion. The buckle unlatches when all three arms are moved to unlatched positions simultaneously. Changing the orientation of the male portion when inserted into the female portion results in the central arm catch being defeated, because there is no corresponding catch cooperation on the back side of the female.

U.S. Pat. No. 5,991,985 to Galbreath discloses a safety buckle with side catch arms and a central catch that engages with a depressible button catch on the female portion of the buckle. To disengage the buckle, the central button on the female portion of the buckle is depressed to either disengage from the central arm or displace the central arm to disengage from a catch. If the male portion of the buckle is inserted into the female portion of the buckle in an opposite orientation so that the central arm does not engage the depressible button catch, the buckle either does not clasp or the central arm does not latch.

U.S. Pat. No. 6,311,374 to Anscher shows a two-operation buckle with a center arm that includes a push button near the base of the male member with a catch near the push button to engage an opening catch in the female member when the buckle portions are engaged. In addition, the buckle is non-reversible, i.e., if the male member is inserted in an opposite orientation, so that the push button faces the back of the buckle assembly, the male and female members do not engage with each other.

U.S. Pat. No. 6,684,466 to Nishida et al. teaches a two-operation safety buckle in which the male member has a center arm with a catch recess that engages a catch on the female member. The center arm of the male member is displaced downwardly during insertion to permit the latch member to protrude into the latch recess when the male member is fully inserted and the center arm returns to its undisplaced position. The center arm is disengaged from the catch with a button on the female member that is pressed to displaced the center arm away from the catch of the female member, so that the male member can be withdrawn from the female member, with the sidearms being depressed together. This buckle configuration is not reversible, in that if the male is inserted in an opposite orientation, the center arm does not latch with the female latch member. Due to the shape of the buckle components, high stress environments may have a further adverse impact on the buckle. For example, if the buckle deforms, a situation where the buckle can be clasped but not unclasped may occur.

U.S. Pat. No. 6,138,330 to Galbreath discloses a two-operation safety buckle in which the sidearms of the male member are prevented from being squeezed together to unlatch the buckle, when the male and female members are engaged together. A blocking device in the female member engages with the latching arms of the male member to prevent their displacement and thus prevent them from being unlatched until the blocking device is displaced away from the latching arms to permit their relative movement. Accordingly, the blocking device is first displaced, and then the arm latches are displaced towards each other until they are free of their respective latches in the female member, at which point the male member can be withdrawn from the female member. The configuration of this buckle permits the male member to be inserted in the female member in an opposite orientation. The blocking device and arm latching functions of this buckle are not independent of each other when the buckle is in a clasped condition. The arms are prevented from being operated due to the blocking device, which is first displaced away from the arms before they may be operated. The sequential operation to unblock the arms represents a major departure from other conventional buckles where the latching mechanisms are independent in the clasped condition. This difference is significant to operation in a commercial environment where buckles are subject to forces that routinely alter their shape. Even slight forces may deform a given buckle, resulting in the buckle being prone to jamming.

Moreover, the buckle of the '330 patent is difficult to manufacture due to practical tolerance limitations in the materials and the amount of area within the confines of the buckle interior. In addition, the buckle configuration is not designed to withstand high impact or compressive forces that are typically encountered in safety buckle applications. The combination of small manufacturing tolerances and lack of resilience to environmental factors contribute to operational problems. For example, small changes in tolerances due to impact or compressive forces, or through extreme temperature ranges, may influence operation of the blocking device leading to buckle failure.

A particular failure mode that is highly undesirable occurs when the deformed buckle can be easily clasped, but becomes extremely difficult to unclasp. Often, such failed buckles may respond to the application of brute force to be opened, such as the application of a high tensile force or prying force. However, a buckle with a blocking action does not respond to brute force methods to open the buckle due to the particular nature of the blocking mechanism design. In such a situation, the belt attached by the buckle is cut away to free the occupant, destroying the usefulness of the belt and buckle.

In each of the above two-operation safety buckles, a change in the orientation of the male member when being inserted into the female member causes the buckle either not to clasp, or defeats the operation of the second operation needed to unclasp the buckle. In a case of the '330 patent to Galbreath, reversing the orientation of the male member does not defeat the two-operation feature of the buckle. However, since the blocking device in the buckle makes the latching mechanisms dependent on each other, the buckle is more difficult to manufacture and operate in practice. In addition, there are challenges to making the buckle of the '330 patent to Galbreath impact resistant or durable in stressful environments. For example, if the buckle becomes deformed due to impact or compression, it is extremely difficult to unlatch the buckle.

Indeed, conventional buckles are made with materials that are inexpensive to avoid increased costs for the buckle components and seatbelts overall, for example. Low cost materials, such as acetal, tend to be brittle and somewhat inflexible, and the structural elements tend to be more difficult to operate. Accordingly, the structural elements that are manipulated to operate the buckle are minimized to maintain the operational characteristics of the buckle and permit the structural elements to be more easily operated. However, this minimization tends to limit the operational robustness of the manipulated structural elements.

It would be desirable to obtain a child resistant buckle with simplified child resistant features. It would also be desirable to obtain a child resistant feature for a safety buckle that can be used in addition to conventional child safety buckle functions.

BRIEF SUMMARY OF THE INVENTION

In accordance with the present invention, there is provided a safety buckle with a passive engagement or latch feature. The passive engagement or latch adds or increases resistance to disengagement of the buckle.

In accordance with an embodiment of the present invention, a latch mechanism is provided that operates when the buckle is clasped to provide a disengagement resistance, or increase the difficulty of disengagement. The latch mechanism can be interactive with other latches or releases in the buckle, so that actuation of the other latches or releases contributes to increasing the disengagement resistance or difficulty. The latch mechanism may also be independent with respect to other latches or releases so that the latch mechanism contributes to disengagement resistance or difficulty regardless of the state of other latches or releases. The latch mechanism can provide a resistance profile according to a number of different shapes or designs. For example, the resistance profile can include a sharp peak, such as the case where the latch mechanism is abruptly freed from a latched state with a buckle in a clasped state. Alternatively, or in addition, the resistance profile may be more continuous, where the latch mechanism provides increased resistance or difficulty over a major portion of a disengagement action.

According to a feature of the present invention, there is provided a safety buckle with a passive catch or disengagement resistance where the buckle parts may be engaged independent of orientation with respect to each other. The passive catch or disengagement resistance is arranged to be functional regardless of the orientation in which the buckle is clasped to contribute to making the buckle consistently child resistant.

In accordance with an embodiment of the present invention, the buckle includes a male and female member, with a center arm on the male member having a shoulder or projection for latching with the female member. The male latching shoulder or projection of the male member is provided on either side of a center arm of the male member, so that the male member latches with a coopertive latch portion on the female member. The male member is disengaged from the female member by displacing the male member away from the female member, for example by pulling the members apart.

According to an advantage of the present invention, the members are separated by squeezing one or more sidearm latches of the engaged buckle, so that the male portion of the buckle is free to be disengaged from the female portion of the buckle. The passive latch or resistance continues to make separation more difficult even when the one or more sidearm latches are free.

According to another advantage of the present invention, the members are separated by squeezing one or more side arm latches of the engaged buckle, so that the male portion of the buckle is pushed away from the female member of the buckle through a spring-like resiliency provided by the one or more side arm latches. Squeezing the one or more latches provides a spring like force to contribute to separating the male and female members of the buckle, so that the passive latch or resistance is overcome with the application of a squeezing force.

In accordance with another feature of the present invention, the side arm latches can be formed to be loaded when displaced inside the female member of the buckle, so that the spring like restoring force of the side arm latches contributes to urging the male and female members apart. Advantageously, the female member may include a ramp structure that cooperates with the side arm latches to promote the spring force of the compressed one or more latches to assist in urging the male and female members apart.

In accordance with another embodiment of the present invention, the buckle is provided with a passive catch that prevents the male and female members from being separated in the absence of a separating force. According to this embodiment, other latch mechanisms in the buckle may be disengaged, and the buckle is still joined until a separation force is applied to the buckle members to separate them. The separation force is provided at a specified level to permit adults to easily separate the male and female members, while children younger than a certain age cannot as easily apply a sufficient separating force.

In accordance with another embodiment of the present invention, a passive catch or resistance provided in the clasped buckle increases the difficulty of separating the male and female members. According to this embodiment, operation of other latches in the buckle to disengage the buckle member may also provide a spring or restoring force that contributes to separating the buckle members. However, the spring like or restoring force provided by actuating other latching mechanism in the buckle may be designed to be insufficient to overcome the passive catch or resistance, so that an additional separating force is applied to separate the male and female members.

In accordance with another embodiment of the present invention, an aperture is provided on the center arm of the male member for receiving a latch projection extending from a side of the female inner chamber. The aperture and the latch projection cooperate to resist disengagement of the clasped buckle. Separation of the buckle involves the application of a separation force to overcome the cooperative force obtained with the interation of the aperture and latch projection.

In accordance with an advantage of the present invention, the aperture provided in the center arm of a male member permits a functional symmetry for the buckle, in that the male and female members may be joined in one of a number of orientations, and the aperture and latch projection continue to cooperate to provide a consistent resistance to separation of the buckle members. In addition, or alternatively, the center arm may be provided with detent or other structures that cooperate with corresponding structures on a female member to contribute to increasing the resistance of the buckle to separation forces.

In another embodiment of the present invention, the male member includes one or more sidearm latches that are provided with a structure for engaging a corresponding structure on the inner surface of the female member. The structure on the one or more sidearm latches, forms a passive catch when the one or more sidearm latches are activated. Alternately, or in addition, the structure increases the resistance to separation of the male and female members. For example, the structure engages one or more corresponding structures on the female after the one or more sidearm latches are displaced to a release position. That is, releasing the one or more sidearm latches engages the resistance structure.

According to a feature of the present invention, a female member of a buckle is provided with a slot that cooperates with a center arm of a male member to provide enough clearance for the center arm of the male member to be displaced a distance sufficient to engage/disengage the center arm from a catch projection on the female. The slot, or trench, permits the center arm to be displaced a greater distance to provide a range of adjustment or tolerance for the passive catch or resistance provided by the cooperation of the center arm and the catch projection. The greater displacement capability of the center arm permits the catch projection on the female member to be extended, so that a more secure child resistant feature can be provided.

According to an advantage of the present invention, the slot in the female member of the buckle and the center arm of the male member are both provided with roughened surfaces, detents or teeth that cooperate to increase the resistance of separation of the male and female members. The cooperating surfaces of the central arm and the slot interact with each other when the central arm is displaced during a buckling or unbuckling action.

In accordance with another feature of the present invention, a center arm of a male buckle member includes a recess, which in an exemplary embodiment is a through opening, to cooperate with a catch protrusion in the female buckle member. By providing the recess or through opening, a longer catch protrusion may be used on the female buckle member to interact with the center arm to secure the buckle as with a passive catch. The use of the longer catch protrusion on the female permits the passive catch aspect to exhibit greater resistance to separation of the buckle parts and improves the child resistant aspect of the buckle.

In accordance with another feature of the present invention, a center post of a male buckle member is tapered to improve a release action from a catch in the female buckle member. The center post may be tapered near an end of the center post, so that the center post need not be displaced as great a distance to enable the passive catch feature to be more easily engaged/disengaged when the center post is displaced in cooperation with the female buckle member catch protrusion. The tapered center member may be provided in combination with the recess or through opening in the center member to provide additional security for the passive catch, while permitting the passive catch to perform more consistently for example. The slot or trench feature provided in the female buckle member may also be used with the taper and recess feature to permit the center member to be displaced a greater distance to improve latch reliability while obtaining a smooth and easy release. These features also contribute, individually or in combination, to increasing operating consistency when the buckle is clasped in multi-orientations.

In accordance with another feature of the present invention, the child resistance of a buckle featuring a passive catch may be improved by providing a false actuator. Such a false actuator can have a non-functioning range of operation, so that it appears to actuate a disengagement mechanism to a child, but has no impact on buckle function. Accordingly, children attempting to actuate the latch in an unlatching operation by operating the false actuator observe no results so that the child is deterred from unlatching the latch.

The buckle of the present invention is composed of a flexible and durable material designed to withstand impact or compressive forces to avoid, for example, permanent deformation of the buckle and create a more robust structure. The buckle may be molded from a variety of materials. These materials may include LDPE, HDPE, ABS, polystyrene, polypropylene sulfides, acetals, polycarbonates, thermoplastic rubbers, and polyesters, among others. According to a feature of the present invention the buckle is composed of a material that is both durable and flexible, such as, for example, impact modified nylon. The use of such a material permits the buckle to have operative structural elements that have greater structural integrity, such as by increasing a dimension of the structural element or elements, without significantly increasing operational difficulty. The selection of such a material contributes to the overall integrity of buckle operation, because it is durable enough to withstand high impact or compressive forces, while permitting the operative structural elements to be relatively easy to operate, even if increased in dimension.

According to another feature of the present invention, the buckle is formed to have latching arms in the male portion that exhibit a particular force resistance to being compressed together. According to this feature, a child is typically unable to compress the latching arms of the male member sufficiently to disengage the buckle, even if a second latching mechanism is unlatched. The force used to operate the buckle is sufficiently low to permit an adult to easily operate the buckle. In an exemplary embodiment, a minimum force to actuate the latching arms is 5 lbs or greater to prevent operation by a child under a certain age. The actuating force can also be less than a maximum force of 16 lbs. to permit easy operation by an adult.

According to an advantage of the present invention, structures are provided on the latching arms to increase their resistance to displacement. These structures can be in the form of ribs, struts or flanges, for example.

The selection of materials for the present invention also contributes to maintaining the child resistant features in harsh environments. For example, the selection of high impact nylon, provided by Dupont as material ST801, permits the child resistant buckle to absorb impact and compressive loading forces without permanently deforming to avoid the loss of child resistant features. The selection of the impact modified nylon also permits tolerances in the manufacture of the buckle to be maintained, even in harsh environments where the buckle is subjected to high impact or compressive forces, or wide variations in temperature. Accordingly, the selection of the material further improves the child resistant features of the buckle by maintaining those features even in outdoor environments or harsh environments, such as when the buckle is used in a shopping cart seatbelt.

According to another feature of the present invention, the buckle is designed to have walls with a shape and/or thickness to maintain a certain level of robustness in maintaining a preferred configuration of the buckle. For example, providing structures that improve the resistance of the buckle to compressive or impact forces, or thickening support structures for the buckle, improves the child resistant nature of the buckle by maintaining child resistant features or tolerances in the face of high external forces applied to the buckle.

Other features and advantages of the present invention will be apparent from the following detailed description to be read with the accompanying drawings as described below.

DETAILED DESCRIPTION OF THE PREFERRED EMBODIMENT

The entire contents of U.S. Application Nos. 60/641,346, 10/811,168 and 11/090,696 are hereby incorporated herein by reference.

Figure 1A:
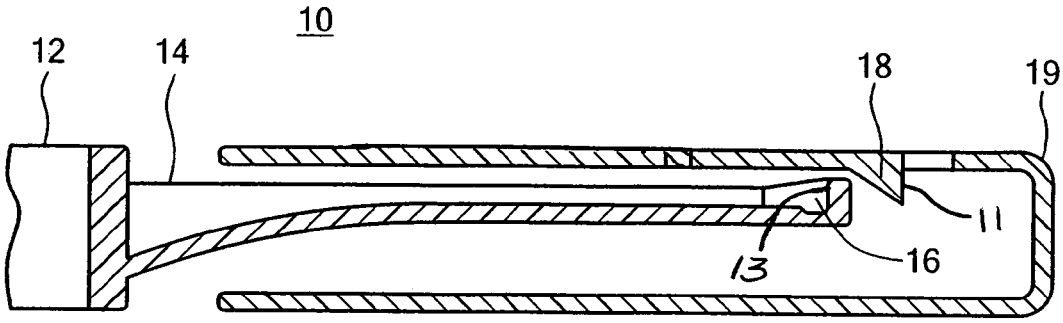
FIGS. 1*a* through 1*c* are central cross-sectional side views showing operation of a passive catch safety buckle in accordance with the present invention.
Figure 1B:
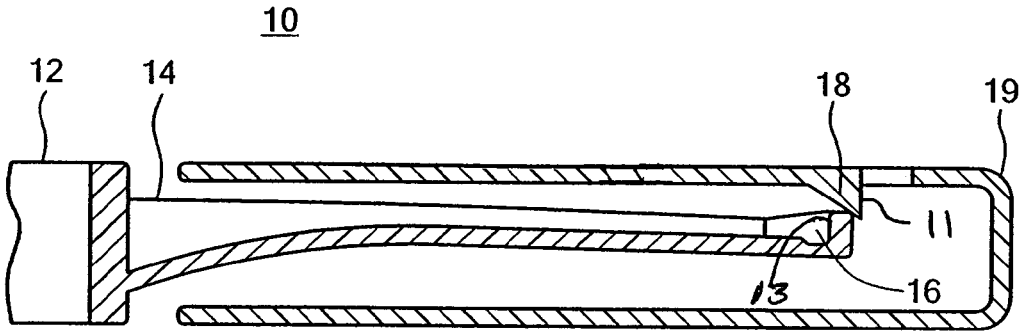
Figure 1C:
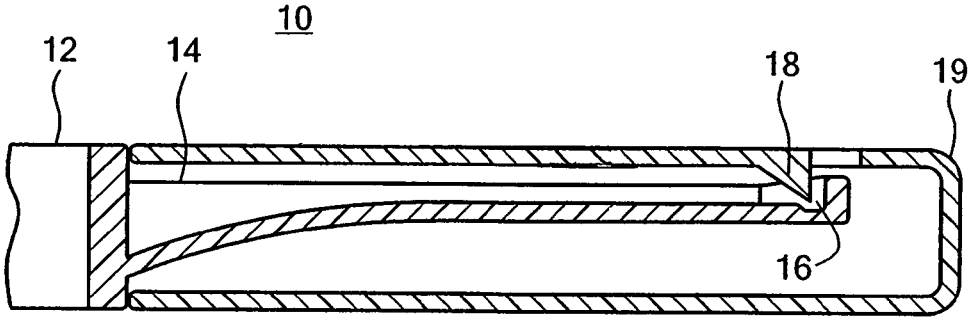

FIGS. 1*a* through 1*c* illustrate a central cross-sectional side view of a safety buckle 10. Buckle 10 comprises a male member 12 having a center arm 14 with a latch recess 16 that engages a catch 18 on a female member 19. As illustrated in FIG. 1*b*, a center arm 14 of male member 12 is displaced downwardly during insertion to permit catch 18 to protrude into latch recess 16 when male member 12 is fully inserted and center arm 14 returns to its undisplaced position, as seen in FIG. 1*c*. Catch 18 includes a surface 11 that cooperates with a surface 13 in latch recess 16 to provide a resistance to separation of male member 12 and female member 19. Once surfaces 11 and 13 cooperate when male member 12 is inserted into female member 19, central arm 14 is more difficult to remove from female member 19.

Center arm 14 is relatively long and flexible to permit an end of central arm 14 near latch 16 to be more easily displaced when male member 12 is inserted into female member 19. The end of center arm 14 near latch recess 16 is displaced downwardly when a sufficient separating force is applied to male and female members 12, 19. According to a feature of the present invention, surface 11 may be sloped or tapered at an angle to adjust the applicable separation force applied to male and female members 12, 19 to overcome the cooperative engagement of latch recess 16 and catch 18. Catch 18 may also be formed to be relatively thin, so that it is somewhat flexible so that a separating force applied to male and female members 12,19 causes deflection of catch 18 in additional to, or alternatively to, central arm 14.

Figure 2:
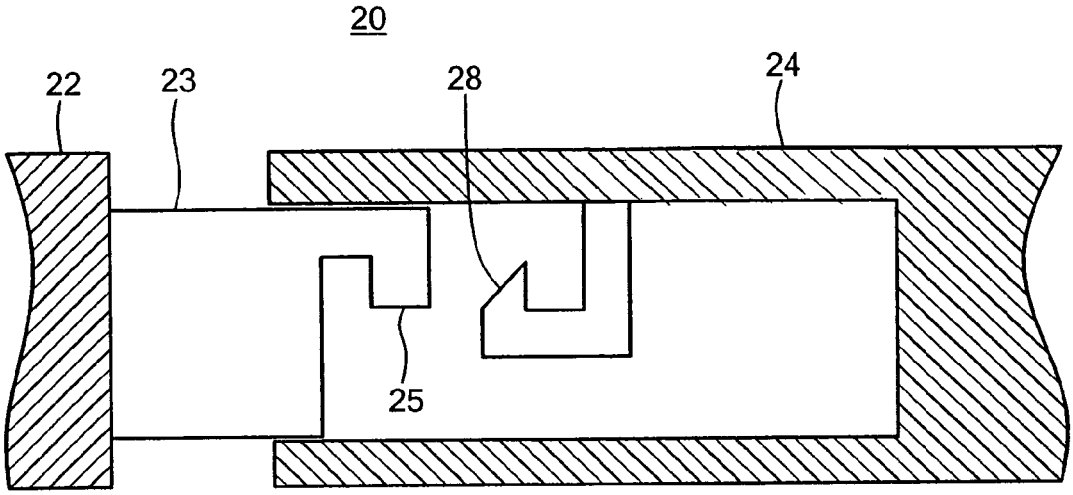
FIG. 2 is a central cross-sectional side view of another embodiment of the safety buckle of the present invention.

Referring now to FIG. 2, a central cross-sectional side view of a safety buckle 20 comprising a male member 22 and a female member 24 is illustrated. Male member 22 includes a central arm 23 having a latch 25. Female member 24 includes a catch 28 that is operable to cooperatively engage latch 25 when male and female members 22,24 are joined. When male member 22 is inserted into female member 24, latch 25 and/or catch 28, deflect to permit engagement, thus providing a passive safety-locking feature.

Male and female members 22, 24 are retained together with conventional side latches (not shown) and latch 25 cooperating with catch 28. Latch 25 rides over a sloped surface of catch 28 to displace latch 25 and/or catch 28 until latch 25 slides past catch 28. Once latch 25 slides past catch 28, latch 25 and/or catch 28 are free to be resiliently urged to a non-displaced position, where latch 25 and catch 28 are engaged.

To disengage buckle 20, a separation force is applied to male and female members 22, 24 sufficient to deflect latch 25 and/or catch 28. The side latches are disengaged, and as the separation force is applied to disengage catch 28 from latch 25, the buckle is free to be separated.

Figure 3:
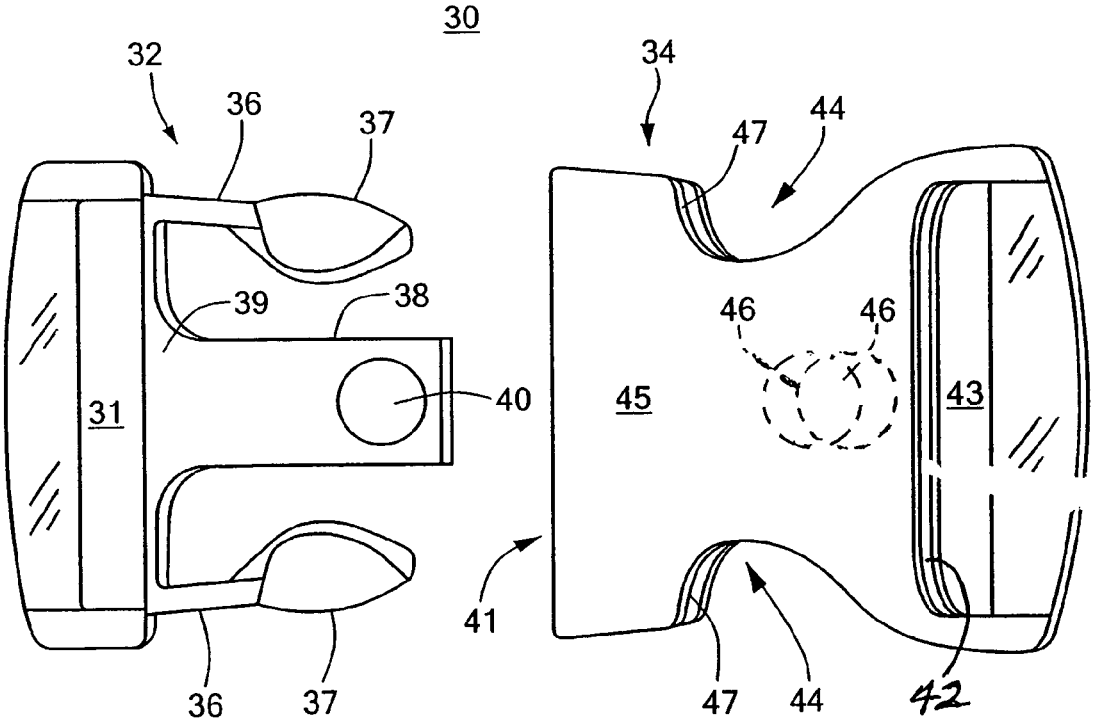
FIG. 3 is a plan view of another embodiment of a male and female portion of a safety buckle according to the present invention.

Referring now to FIG. 3, another embodiment of a passive catch safety buckle 30 according to the present invention is illustrated. Safety buckle 30 is composed of a male member 32 and a female member 34. Male member 32 includes side-arms 36 and a center arm 38 connected to a base 39. A distal end of a sidearm 36 has enlarged heads 37. Center arm 38 has a latch projection 40 extending from a distal end 39 thereof. Extending through base 39 opposite from heads 37 is strap recess 31 for receiving a belt or other fastening instrument. Female member includes an inner cavity 42 with an open end 41. Female member 34 also includes strap recess 43 for insertion of a strap or other band equivalent. Recesses 44 are provided on sides of female member 44 for receiving heads 37 of male member 32. Recesses 44 are arranged to receive heads 37 at substantially full insertion of male member 32 and permit arms 36 to be resiliently urged to a clasped position.

In accordance with the present invention, a top and bottom inner surface of female member 34 are provided with recesses 46 for receiving latch projection 40, independent of the orientation of male member 32. That is, male member 32 is securely received in female member 34 to engage heads 37 and projection 40 without regard to whether projection 40 extends toward or away from a surface 45 of female member 34. Upon insertion into female member 34, center arm 38 is biased due to latch projection 40 abutting an inner surface of female member 34. Biased center arm 38 and latch projection 40 are sized to fit in cavity 42 of female member 34. When male member 32 is fully inserted, biased center arm 38 drives projection 40 into recess 46 to create a second latch feature for added child safety.

When male member 32 is inserted and secure in female member 34, in any given orientation, buckle 30 is unclasped with two actions, pinching heads 37 to be free of shoulders 47 and displacing projection 40 to be free of recess 46. Projection 40 is displaced to be free of recess 46 through the application of a separation force on male and female members 32, 34. By pulling apart or separating male and female members 32, 34, projection 40 is urged out of recess 46 through a contact with side walls of recess 46. The resilient bias provided by arm 38 increases the difficulty experienced in separating male and female members 32, 34, because the cooperation between projection 40 and recess 46 is first overcome to deflect arm 38 and displace projection 40 out of recess 46.

The separating force applied to male and female members 32, 34 may be increased through a squeezing or pinching force applied to heads 37, which have an angled arrangement with respect to arms 36. The applied squeezing or pinching force provides a force vector that tends to eject male member 32 from female member 34. Accordingly, increased squeezing force on heads 37 can be the sole source of the separation force provided to overcome the cooperation between projection 40 and recess 46. In such an instance, no additional separation or pulling force need be applied. Moreover, application of a squeezing or pinching force to heads 37 contributes to ejecting male member 32 from female member 34, so that a separation force applied by the user is enhanced with application of the pinching or squeezing force on heads 37. Various parameters relating to the relationship of arm 38, projection 40 and recess 46 can be adjusted to modify the additional separating force used to overcome the cooperation between projection 40 and recess 46.

Figure 4:
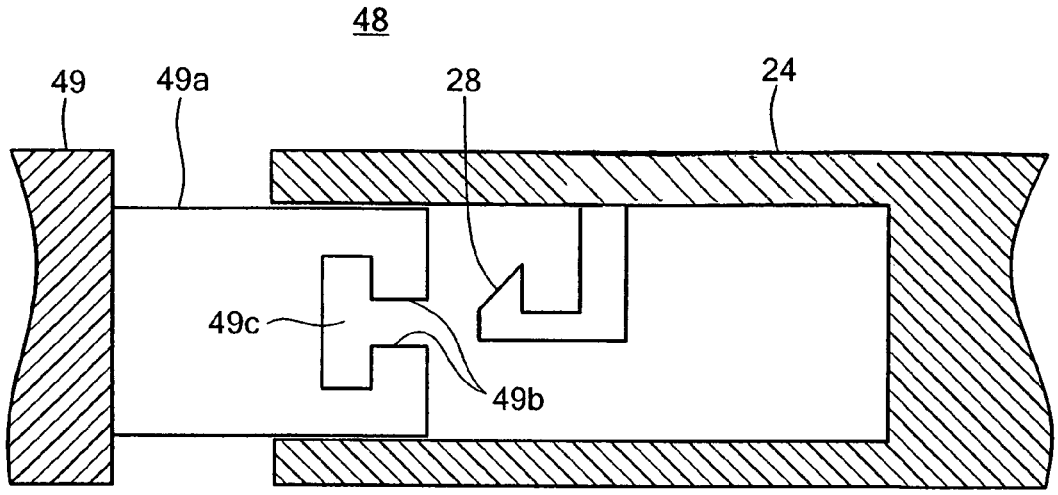
FIG. 4 is a side cross-sectional view of another embodiment of a safety buckle according to the present invention.

Referring now to FIG. 4, a cross-sectional side view of another embodiment of the passive catch safety buckle according to the present invention is illustrated as buckle 48. Buckle 48 includes female buckle 24, as illustrated in FIG. 2, and male buckle portion 49 modified to be reversible, or functionally symmetrical with respect to orientation. Male buckle 49 includes central arm 49*a* with symmetrical latches 49*b*. Latches 49*b* engage catch 28 when male buckle portion 49 is in any given orientation, that is, male buckle portion 49 may be reversed. Symmetrical latches 49*b* are separated by a distance sufficient to permit catch 28 to be inserted and removed from a cavity 49*c* to permit latching and unlatching actions. Buckle 48 is released from a clasped configuration by disengaging all other latches and applying a separation force to male and female portions 49, 24 to disengage catch 28 from an engaged latch 49*b*. Latches 49*b* and/or catch 28 can be arranged so that one or more are pliable to permit a certain amount of flexibility when catch 28 and latches 49*b* are engaged or disengaged. For example, catch 28 may be constructed to permit a certain amount of stretch or reach, during a disengagement action, so that male portion 49 is resiliently retained in female portion 24 with catch 28. In such an instance, as catch 28 is stretched, it eventually releases latches 49*b* to permit male portion 49 to be removed from female portion 24. If insufficient force is applied to release catch 28 and latches 49*b*, the resilient structure of catch 28 tend to maintain male portion 49 in a clasped position in female portion 24. The parameters related to the construction of latches 49*b* and catch 28 can be adjusted to provide a desired amount of retaining force or release at a particular level of applied separation force.

Figure 5:
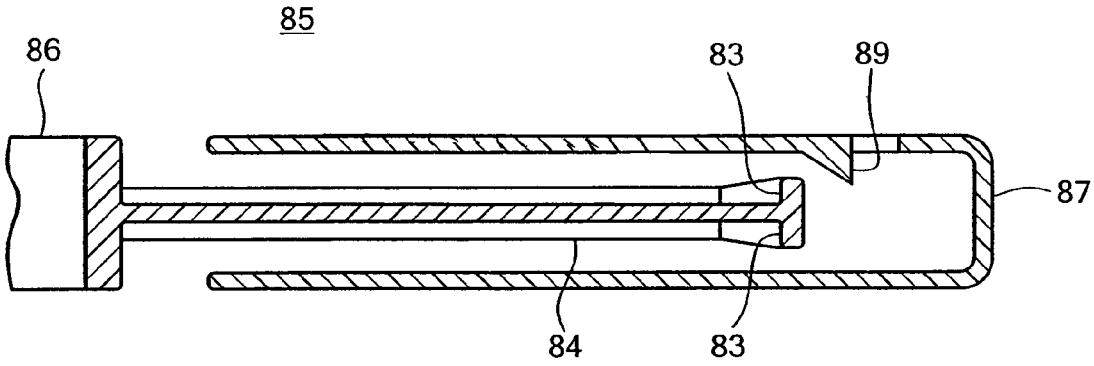
FIG. 5 is a cross-sectional side view of another embodiment of a safety buckle according to the present invention.

Referring now to FIG. 5, a buckle 85 according to the present invention is illustrated with a male member 86 and a female member 87. Female member 87 includes a catch 89 that cooperates with a central arm 84 of male member 86. Central arm 84 includes latches 83 that engage catch 89 when male member 86 is inserted into female member 87 in any given orientation. Latches 83 are disengaged from catch 89 by application of a separation force that deflects central arm 83 and/or catch 89 to displace latches 83 to be free of catch 89. Because central arm 84 is physically and/or functionally symmetrical with respect to an axis of male member 86, for example, male member 86 can be inserted into female member 87 in either orientation and obtain a secondary latch feature through the cooperation of latches 83 and catch 89. Catch 89 also includes a sloped surface to permit central arm 84 to be flexibly displaced when male member 86 is inserted into female member 87, so that central arm 84 can be urged to resiliently return to permit latches 83 and catch 89 to cooperate. The separation force may be assisted by spring loaded tangs in another latch mechanism, which can contribute a separation force when actuated to disengage the latch mechanism.

Figure 6:
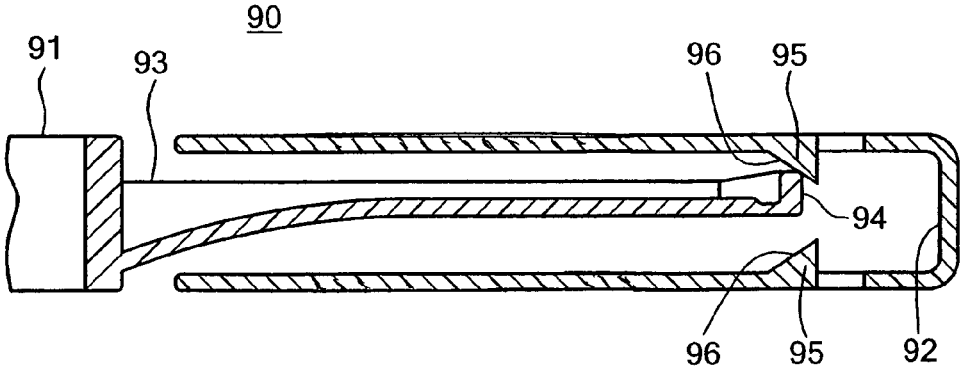
FIG. 6 is a cross-sectional side view of another embodiment of a safety buckle according to the present invention.

Referring now to FIG. 6, a buckle 90 according to the present invention is illustrated with a male member 91 and female member 92. Male member 91 has a central arm 93 with a latch 94 that cooperates with catches 95 on female member 92. Catches 95 include sloped surfaces 96 that deflect the front end of central arm 93 when male member 91 is inserted into female member 92. Central arm 93 resiliently flexes as latch 94 rides over sloped surface 96, until latch 94 passes catch 95, at which point central arm 93 resiliently returns to permit cooperative engagement of catch 95 and latch 94. At that point, male member 91 is secured in female member 92 by the cooperation of latch 94 and catch 95. Male and female members 91,92 are disengaged by releasing other latch mechanisms accessible by an operator, and applying a separation force to release latch 94 and catch 95. Other latch mechanisms may be provided with a spring force so that actuation of the mechanism to unclasp the buckle also contributes to separating male and female members 91, 92.

Figure 7:
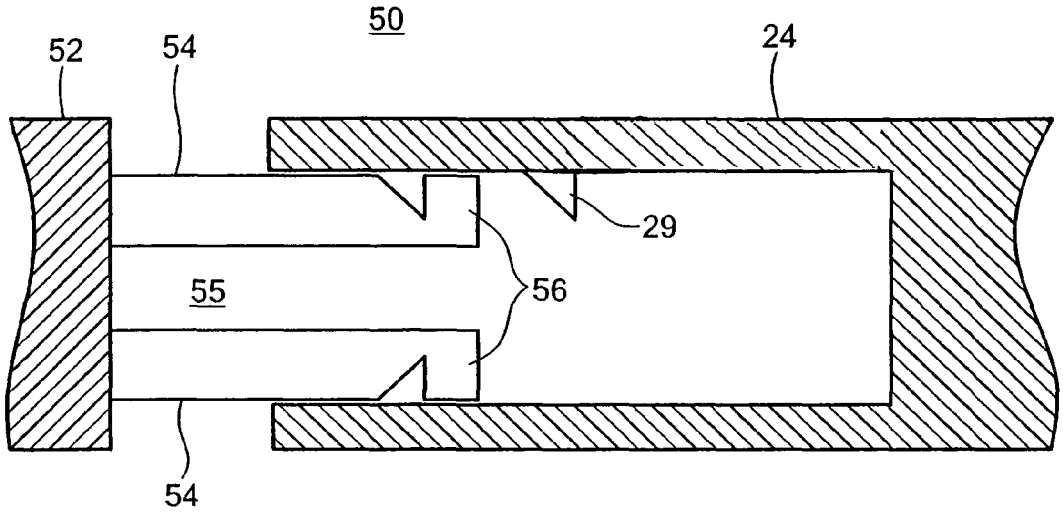
FIG. 7 is a cross-sectional side view of another embodiment of a safety buckle according to the present invention.

Referring now to FIG. 7, a buckle 50 according to the present invention is illustrated with a female member having similar construction to female member 19 of FIGS. 1*a*-1*c*. Buckle 50 includes a male member 52 with central arms 54 that engage catch 29 with one of latches 56. When male portion 52 engages female portion 24, latch 56 rides over catch 29 and returns resiliently to a less flexed position where latch 56 and catch 29 are engaged. Arms 54 are separated by a space 55 to permit arms 54 to flex towards each other without interference from an opposite arm 54. Male and female members 52, 24 are disengaged through application of a separation force, which tends to deflect arm 54 downward until latch 56 is free of catch 29. At the same time, side arms (not shown) are pinched together to be disengaged from cooperative retaining shoulders (not shown) to permit male and female members 52 and 24 to be separated. Because male member 52 includes functionally symmetrical arms 54 with functionally symmetrical catches 56, male member 52 can be reversed in orientation and still provide a secondary latching feature in buckle 50.

Figure 8:
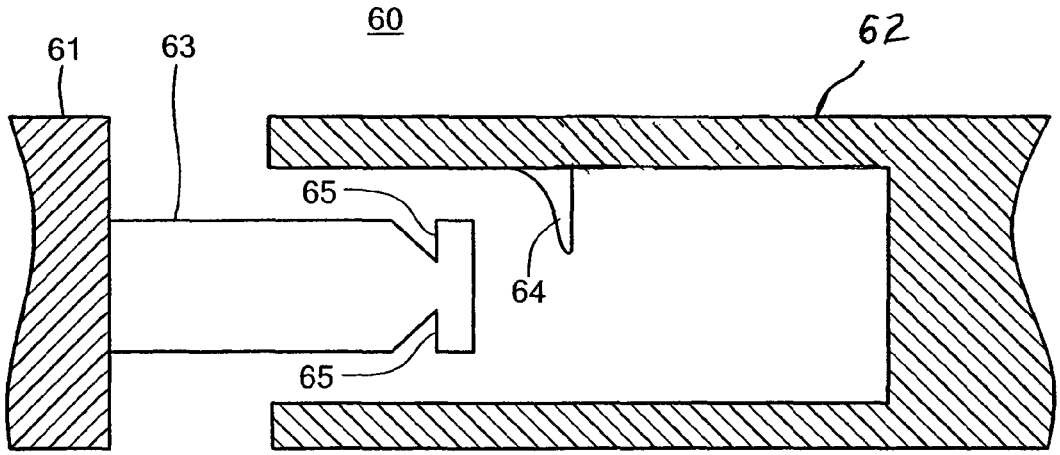
FIG. 8 is a cross-sectional side view of another embodiment of a safety buckle according to the present invention.

Referring now to FIG. 8, a reversible buckle 60 with a passive catch according to the present invention is illustrated. Buckle 60 includes male and female members 61,62 that securely cooperate to provide a safety buckle clasp. Male member 61 includes a central arm 63 that is resiliently flexible to contribute to a secondary latching feature of buckle 60. Arms include latches 65 that engage with a catch 64 when male member 61 is completely inserted into female member 62. As an end of central arm 63 is inserted into female member 62, it meets with and is deflected by catch 64. As male member 61 continues to be inserted into female member 62, central arm 63 and/or catch 64 is deflected until latches 65 move past catch 64, at which point central arm 63 and/or catch 64 resiliently returns to a less flexed position. A secondary, passive latching feature of buckle 60 is thus engaged. To disengage buckle 60, a separation force is applied to male and female members 61,62, imparting an opposing force to catch 64 and latch 65, tending to flex arm 63 and/or catch 64. As arm 63 and/or catch 64 flex, latch 65 is urged out of cooperation with catch 64. Once latch 65 is free of catch 64, male member 61 can be disengaged from female member 62 by also pinching the side arms (not shown) of male member 61 to free them from their cooperating shoulders (not shown) on female member 62. Central arm 63 of male member 61 is physically and/or functionally symmetrical about a central axis of male member 61. The symmetry exhibited by arm 63 permits the passive catch to function in a number of orientations. Male member 61 may be inserted into female member 62 in any given orientation, i.e., orientations of male member 61 that are separated by 180 degrees with respect to a central axis of male member 61.

Figure 9:
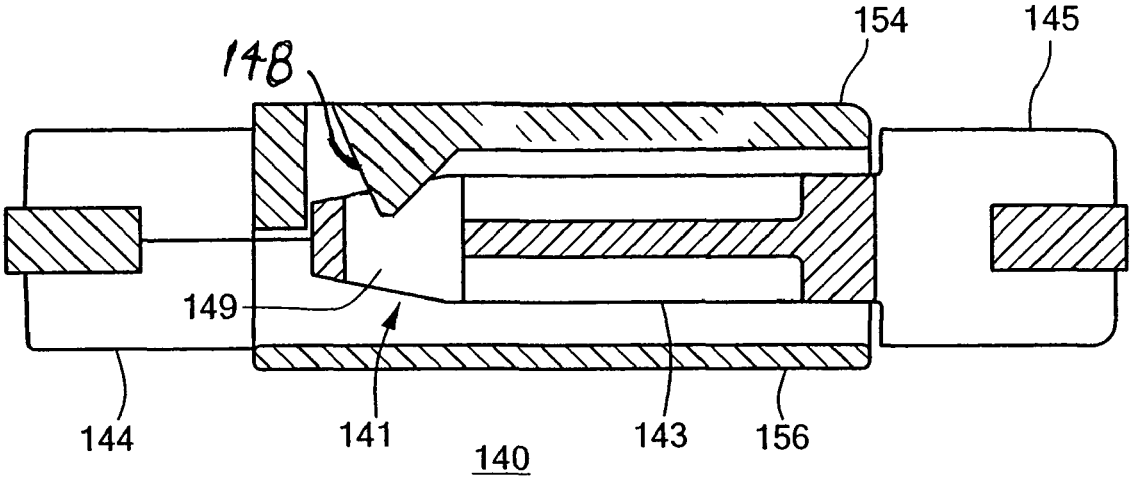
FIG. 9 is a plan view of a plug part according to another embodiment of the present invention.

Referring now to FIG. 9, a buckle 140 according to the present invention is illustrated in an assembled state. Female member 144 receives male member 145 in a latched position to clasp buckle 140. Female member 144 includes a catch extension 148 that cooperates with an opening 149 on male member 145. Male member 145 is disengaged from female member 144 when side tangs 142 (FIG. 10) are pinched together and center arm 143 is freed from catch extension 148. Center arm 143 is deflected away from catch extension 148 through a separation force applied to male and female members 145,144. The deflection permits center arm 143 to be free of catch extension 148 to permit male member 145 to be disengaged.

Female member 144 includes a top wall 154 and a bottom wall 156 that contribute to support for the structural integrity of female member 144. In addition, male member 145 includes a tapered area near opening 149 to contribute to the operability of buckle 140. When center arm 143 is displaced away from catch extension 148, tapered area 141 contributes to easing the release of center arm 143 from catch extension 148 by providing additional clearance so that the latching mechanism operates with less deflection, and without the application of an overly burdensome separation force. Center arm 143 can generally remain at a thicker dimension than tapered area 141, so that the structural integrity of male member 145 is maintained. Through opening 149 also permits catch extension 148 to extend further than otherwise might be feasible, while maintaining a passive catch feature. Catch extension 148 can extend into through opening 149 to contribute to securing male member 145 and female member 144. In this embodiment, at least two of the latching mechanisms are arranged on adjacent sides or surfaces of the buckle, and are not opposed to each other.

Figure 10:
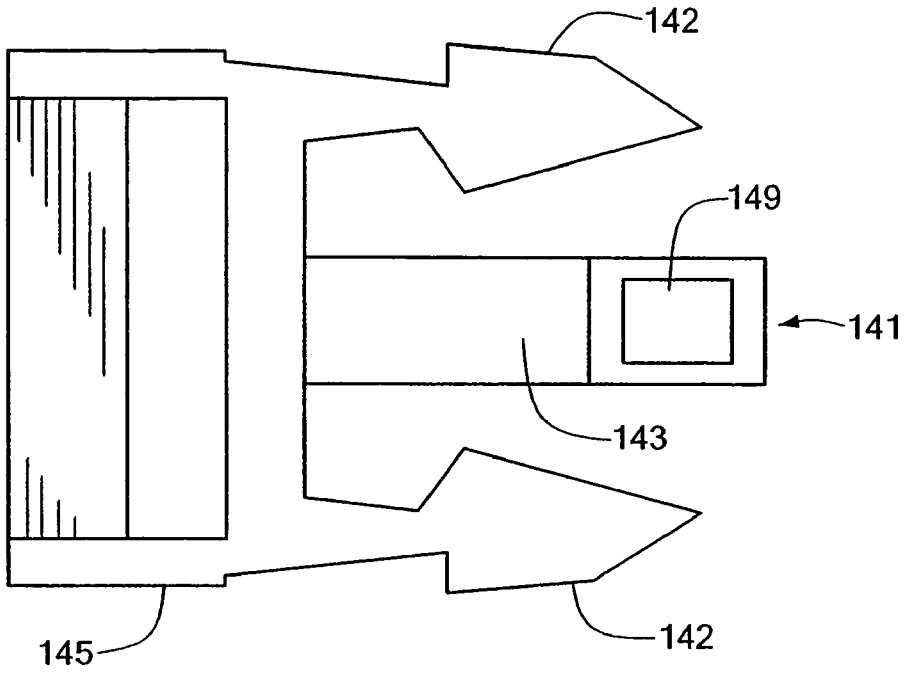
FIG. 10 is an end side view of a socket part according to another embodiment of the present invention.

Referring now to FIG. 10, another illustration of male member 145 is provided. Through opening 149 is shown on center arm 143 in tapered area 141 to serve as a latch member for securing male member 145 in buckle 140. Tangs 142 provide the male portion of a latch mechanism that is activated by the operator.

Figure 11:
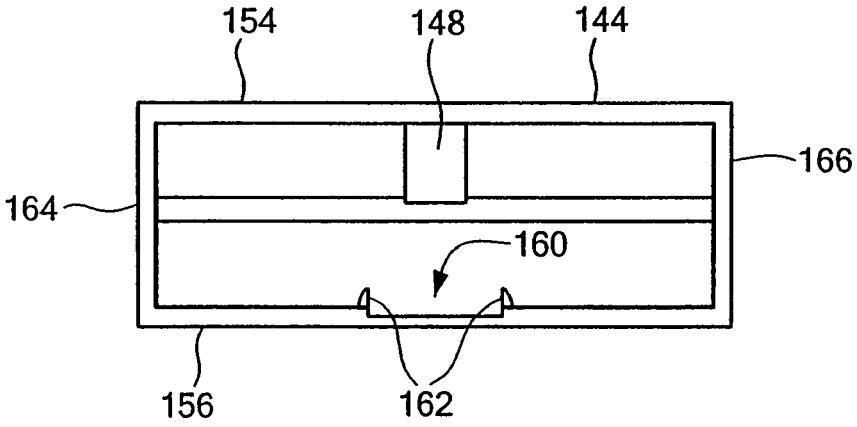
FIG. 11 is a cross-sectional side view of an embodiment of a safety buckle according to the present invention.

Referring to FIG. 11, female member 144 is illustrated with a view of an opening for receiving male member 145. Catch extension 148 is illustrated in the center of the view of female member 144 for engaging center arm 143 of male member 145. In addition, a slot or trench 160 is illustrated in a side of bottom wall 156. Trench 160 provides a clearance for the deflection of the center arm 143 when male member 145 is disengaged from female member 144. Accordingly, trench 160 eases the operation of center arm 143 during a disengagement operation to facilitate an easy unclasping operation. Female member 144 may also include guide rails 162 that project upward from bottom wall 156. Guide rails 162 help to guide center arm 143, and male member 145 into female member 144 without lateral rotation, and also tend to stabilize the clasped buckle to prevent inadvertent unclasping through rotation or other lateral forces. It should be apparent that guide rails 162 may be alternately or additionally positioned on a side of top wall 154 to improve stability, for example.

Because male member 145 is reversible, it may be inserted in female member 144 in any given orientation and still achieve the objects and advantages of the present invention. An important goal of the buckles illustrated according to the present invention is that they be operable on an intuitive level by users that may be encountering the buckle for the first time. Accordingly, the buckle should be easy to use and operate in a consistent manner. The reversible feature of the present invention permits the user to insert male member 145 into female member 144 in any orientation so that the intuitive operation of the buckle is improved. The cooperating features of through opening 149, catch extension 148, tapered area 141 and trench 160 serve to provide a robust latch mechanism, while facilitating a simple and convenient opening mechanism to unclasp buckle 140.

The above-described features can be made consistent when buckle 140 is produced with designs that allow flexibility and tolerances variations, and with materials that do not permanently deform over a significant amount of time. Accordingly, buckle 140 is designed to have structural features to prevent deformation of buckle 140, even when it is subjected to high impact and compressive loading. Because buckle 140 is made out of impact modified nylon in an exemplary embodiment, buckle 140 tends to be relatively pliable, which improves the resistance of the buckle to cracking, stress fractures, or breaking. In addition, side tangs 142, center arm 143 and catch extension 148 can be made more robust and thicker yet remain pliable to facilitate use, thereby improving durability while maintaining operative ease. Also, top and bottom walls 154, 156, as well as side walls 164, 166 of female member 144 can be made thicker to resist impact or compressive loading. Walls 154, 156, 164, 166 can also include structural elements to improve their resistance to loading, such as ribs, one or more arcs of thicker material, and the like. The structure of buckle 140 compensates for the pliability of the impact modified nylon so that buckle 140 can withstand higher external force loading, as well as wide variations in temperature and humidity as are typically experienced in outdoor use.

Figure 12:
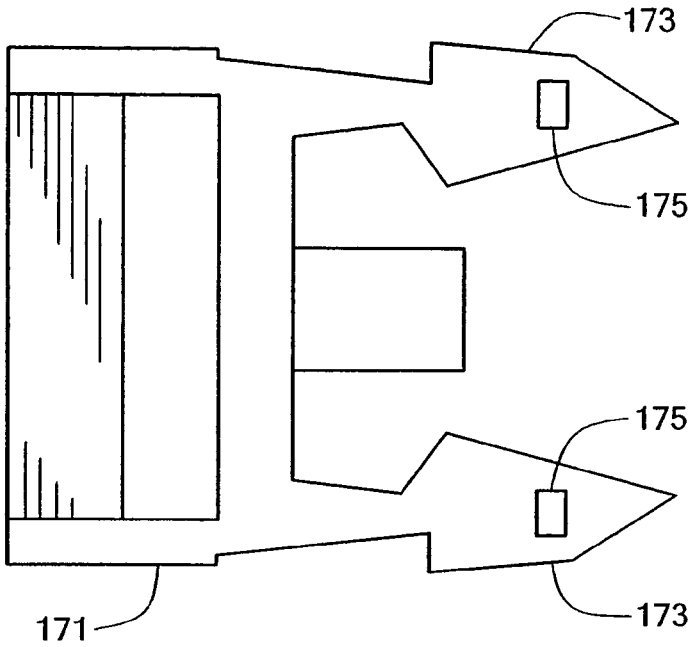
FIG. 12 is a plan view of another plug part according to another embodiment of the safety buckle according to the present invention.

Referring to FIG. 12, another embodiment of the present invention is illustrated with male buckle component 171. Component 171 has latches or catches 175 that interact with cooperative catches or latches on a female buckle component to form a second passive latch. The first latch, formed with side arms 173 cooperates with shoulders on a female component and operates as usual, with side arms 173 being pinched to be released from the shoulders. Latches or catches 175, may be in the form of protrusions or recesses, for example, that interact with cooperative recesses or protrusions. The recesses and/or protrusions may be on either of the male or female components. It should be apparent that latches or catches 175 may be configured to be below arms 173 or in combinations above and below so that actuation releases arms 173, or in combinations above and below. Also, one or more latches may be used and the buckle remains reversible.

Figure 13:
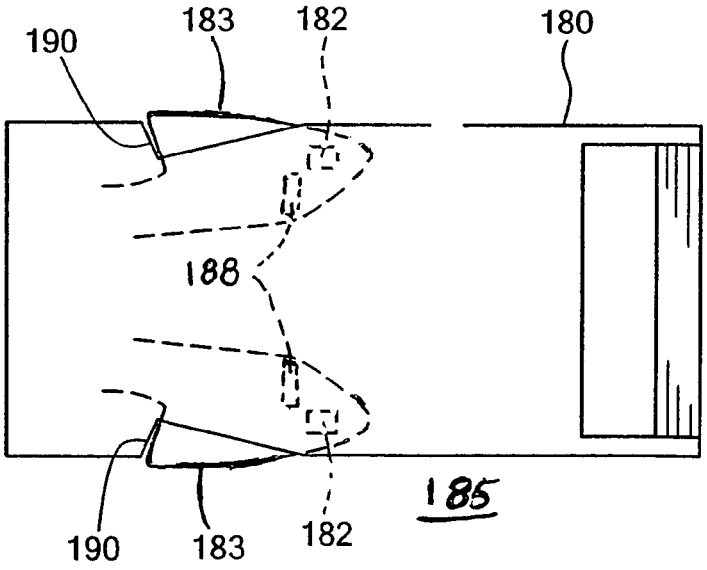
FIG. 13 is a plan view of a clasped buckle according to an embodiment of the present invention.

Latches or catches may be provided, for example, on one or more of the flexible arms of a plug component of a buckle to interact with cooperating catches or latches on a socket component when the arms are squeezed in a disengagement action. Referring to FIG. 13, arms 183 are shown in a clasped condition with latches or catches 182. Latches or catches 182 interact with cooperative catches or latches 188 when arms 183 are squeezed or pinched together. Squeezing arms 183 together frees them from shoulders 190 to permit buckle 185 to be released. During the pinching operation to free arms 183, latch components 182 move into a position to cooperate with latch components 188. When latch components 182 and 188 cooperate, they form a passive latch that contributes to the resistance of the separation of the male and female portions of buckle 185. According, the passive latch formed by latch components 182, 188 is sequential with respect to buckle operation to unclasp buckle 185.

Figure 14:
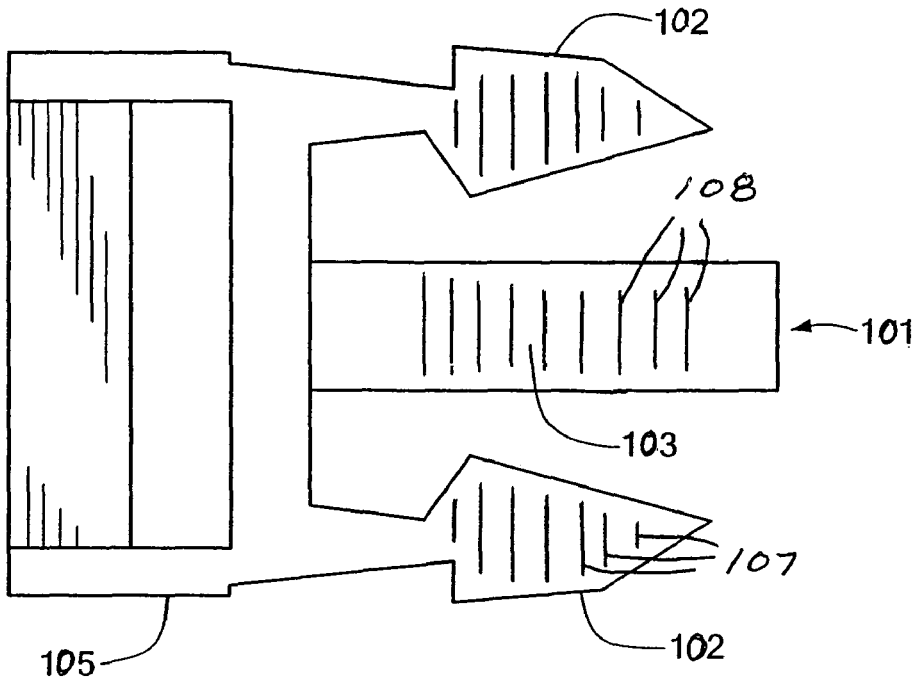
FIG. 14 is a plan view of a plug part according to an embodiment of the present invention.
Figure 15:
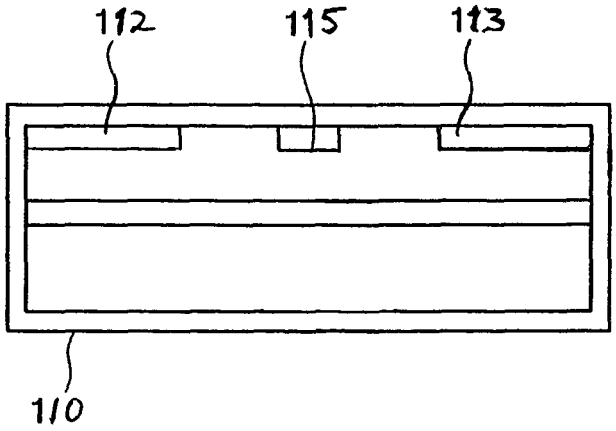
FIG. 15 is an end side view of a socket part according to an embodiment of the present invention.

Referring now to FIGS. 14 and 15, another embodiment of the present invention is illustrated with plug component 105 and socket component 110. Plug component 105 includes one or more sections with detents or teeth to cooperate with corresponding portions of socket component 110. For example, arms 102 may include detents or teeth 107 that cooperate with corresponding structures 112, 113 to resist removal of plug 105 from socket 110. Alternately, or in addition, detents or teeth 108 may be provided on arm 103 to cooperate with corresponding detents or teeth on structure 115 in plug 110. Plus 105 and socket 110 with detents or teeth 107, 108 illustrates exemplary embodiments for increasing the resistance of separation of plug 105 from socket 110. Many other structures or forms for contributing resistance to the removal of plug 105 from socket 110 to form or contribute to forming a passive catch is contemplated as within the scope of the present invention and this disclosure, including adhesives, increased friction materials, snap or compressive joining structures, and so forth. For example, a passive catch may be formed in a buckle according to the present invention to move from a non-loaded to a loaded condition when the buckle is clasped, so that an increased resistance of separation of the buckle components is realized. Various structures that depend upon compression or resiliency, such as spring structures, may be used to form the passive latch and the buckle according to the present invention.

In designing a child resistant buckle, a number of factors may be observed as having an impact on child resistance. For example, the pressing force used to actuate a buckle may be set to contribute to child resistant features, as well as providing a passive catch to release a child resistant buckle. One factor that can contribute to forming and maintaining a child resistant buckle is the orientation of the buckle in a child seat restraint. It has been found that the orientation of a buckle can add to the difficulty in opening a buckle in a child seat for the child. At the same time, the orientation of the buckle makes it easier for the person, presumably an adult, who is releasing the child to operate the buckle.

It is well documented that a majority of people are right handed by nature, including young children. The passive catch buckle according to the present invention is typically constructed with a plug and socket, or male and female portions. A user typically releases the buckle by pinching the side arms with the thumb and forefinger of one hand, while applying a separate force with the other hand, typically by gripping a strap coupled to the male portion and pulling. It has been found that children have a more difficult time opening these types of buckles when the left hand is used to attempt to pinch the side arms, and the right hand is used to separate the buckle. The preference for actions using the right hand contributes to the difficulty faced by children using their left hand to pinch the side arms. Therefore, in accordance with the present invention, seatbelts with buckles with passive catch functionality are installed in child seats so that when the child attempts to open the buckle, the left hand is used to pinch the side arms, and the right hand is used to pull the buckle apart. This configuration makes the buckle generally more difficult for the child to open, and thus more child resistant.

While the buckle orientation discussed above is more difficult for a child to open, the orientation actually facilitates an adult or other person unbuckling the buckle. Typically, the person releasing the child from the seat faces the child, and is automatically presented with the easier orientation to open the buckle. The person typically pinches the side arms of the buckle with their right hand, while pulling the buckle apart with the left hand, making the buckle intuitive and easy to release, while having an improved child resistant feature.

To achieve the desired orientation for the seatbelt and child resistant buckle, the male portion of the buckle, or plug, is attached to be presented from the right side of the child in the seat. The female member, or socket, is attached to be presented from the left-hand side of the child in the seat. In this orientation, the child's more natural inclination in attempting to open the clasped buckle is to apply a squeezing force to the tangs with the left hand, while attempting to pull the buckle apart with the right hand, resulting in a more difficult operation from the perspective of the child.

An adult or other person coupling the seatbelt and typically facing the seated child has the female member, or socket, presented on their right hand side, while the male member, or plug, is presented on the left hand side of the adult or other person operating the buckle and the seatbelt. Accordingly, when the buckle is clasped, the adult will more naturally open the buckle using their right hand to squeeze the tangs, while using their left hand to pull on a strap coupled to the male portion to overcome the passive catch to unclasp the buckle, leading to an easier operation of the buckle for the adult. Surprisingly, this simple feature of orientation accomplishes several goals of the present invention, such as making the buckle generally more difficult to open for a child, while also providing an intuitively simple way for an adult to unclasp the buckle.

In accordance with a particular feature of the present invention, a buckle and/or seatbelt is provided with indicia related to orientation of the buckle and/or seatbelt to obtain the above-described advantages with respect to orientation of a male and female buckle member. For example, the strap of the seatbelt may include a sewed on or otherwise attached label with instructions for use, warnings, etc. that are more easily read or properly presented to a user standing at the shopping cart when the seatbelt is secured to the shopping cart in a proper orientation according to the present invention. That is, the indicia is properly presented to the user when the female buckle member is attached on a right hand side, and the male buckle member is attached on a left hand side from a perspective of the user.

Similarly, indicia on the buckle may be provided, such as serial numbers, warnings or instructions, for example, to indicate the appropriate orientation of the seatbelt when the seatbelt is secured to the shopping cart in an orientation that achieves the advantages of the present invention. In this way, installation or maintenance of the seatbelt in a proper orientation is intuitive to the installation or maintenance personnel. The indicia on the seatbelt or buckle also serves as a redundant method for orienting the seatbelt to obtain the advantages of the present invention, beyond instructions provided in an installation guide for the seatbelt, for example. Accordingly, the provision of indicia to orient the seatbelt and buckle properly contributes to improving the child resistance of the seatbelt. The indicia helps to ensure that a proper orientation is maintained to enhance the child resistance of the seatbelt.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A child resistant buckle, comprising:

first and second buckle members shaped to be cooperatively joined in a clasped condition;

a passive latch mechanism that includes releasably cooperative components on the first and second buckle members respectively, arranged to be releasably cooperative when the first and second buckle members are joined in the clasped condition to retain the first and second buckle members together;

the passive latch mechanism being disengagable through application of a separation force applied to both the first and second buckle members to urge the first and second buckle members away from each other, the separation force being transferred to the cooperative components in an unclasping action;

the cooperative components being configured to oppose each other in a direction of the separation force to resist the separation force;

at least one of the cooperative components being resiliently displaced or deformed by another cooperative component of the passive latch mechanism when the separation force is transferred to the cooperative components sufficient to permit the applied separation force to overcome the separation resistance provided by the cooperative components to disengage the cooperative components to permit the buckle to be unclasped; and another latch mechanism that includes releasably cooperative engagement structures on respective first and second buckle members and being externally accessible for actuation to permit disengagement of the engagement structures.

2. The buckle according to claim 1, further comprising an orientation symmetry for the latch mechanism, whereby at least one of the cooperative components engages another cooperative component in the clasped condition independent of relative orientation of the first and second buckle members.

3. The buckle according to claim 1, further comprising a central arm on one of the first or second buckle members, arranged to extend into the other buckle member in the clasped condition, one or more cooperative components being located on the central arm.

4. The buckle according to claim 1, wherein the cooperative components of the passive latch mechanism are located substantially internally to the buckle in the clasped condition.

5. A buckle according to claim 1, further comprising:

a release mechanism for the another latch mechanism, actuable to disengage the cooperative engagement structures through the application of a pinching force on the buckle in the clasped condition; and the release mechanism translating a portion of the pinching force into a separation force to contribute to disengagement of the passive latch mechanism.

6. The buckle according to claim 1, wherein the buckle is constructed of a material comprising impact modified nylon.

7. The buckle according to claim 5, wherein the another latch mechanism further comprises a non-functional range of operation such that the another latch mechanism may be operated in the range without actuating the another latch mechanism to disengage the engagement structures.

8. The buckle according to claim 1, wherein the cooperative components further comprise:

at least one projection on one of the first or the second buckle member that extends in a direction being transverse to the direction of the separation force; and at least one recess that includes an edge on another of the first or the second buckle member and positioned to receive the at least one projection in the clasped condition such that the at least one projection and the edge of the at least one recess oppose each other in the direction of the separation force.

9. The buckle according to claim 8, further comprising:

the one of the first or the second buckle member being a socket that includes a cavity for receiving the another of the first or the second buckle member in the clasped condition; and the projection being located in the cavity.

10. The buckle according to claim 9, further comprising:

the another of the first or the second buckle member being a plug that includes a central arm for insertion into the cavity of the one of the first or the second buckle member in the clasped condition; and the at least one recess being located on the central arm.

11. The buckle according to claim 8, further comprising:

the one of the first or the second buckle member being a plug that includes a central arm for insertion into the another of the first or the second buckle member in the clasped condition; and the projection being located on the central arm.

12. The buckle according to claim 11, further comprising:

the another of the first or the second buckle member being a socket that includes a cavity for receiving the central arm of the one of the first or the second buckle member in the clasped condition; and the at least one recess being located in the cavity.

13. A method for providing a child resistant buckle comprising:

arranging a passive latch mechanism internally to a clasped buckle configuration that includes two separable members;

arranging at least one cooperative component on each of the two members as part of the passive latch mechanism such that the at least one cooperative components oppose each other in a direction of an applied separation force applied to urge the separable members apart from each other to unclasp the buckle;

forming one or more of the cooperative components to be resiliently displaced or deformed by another of the cooperative components of the passive latch mechanism when the separation force is applied and transferred to the cooperative components to permit the separation force to overcome the resistance to separation provided by the cooperative components and thereby disengage the cooperative components to permit the buckle to be unclasped; and arranging a second latching mechanism with releasably cooperative engagement structures on the respective buckle members to be externally accessible to permit release by a user.

14. A child resistant buckle, comprising:

a passive latching mechanism with a first engagement structure being located on a central arm of one buckle part and a second engagement structure being located in a cavity of another buckle part, the central arm being receivable in the cavity to permit the first and second engagement structures to cooperatively engage to retain the one and another buckle parts together in a first relative orientation;

a complementary engagement structure being located on the central arm or in the cavity to cooperatively engage with the first or the second engagement structure in a second relative orientation different from the first relative orientation;

the engagement structures being substantially non-accessible for disengagement when the buckle is clasped; and the one and another buckle parts being free of an unlatching mechanism for the passive latching mechanism, such that the passive latching mechanism can be disengaged through a separation force applied to urge the one and another buckle parts away from each other and unclasp the buckle.

15. A child resistant buckle that includes a plurality of interfitting buckle members, comprising a passive latch mechanism internal to the buckle upon being clasped, components of the passive latch mechanism operating on each other in an unclasping action to disengage the components when a sufficient separation force is applied to the buckle in a direction to separate the buckle members to thereby displace or deform one or more of the components against another component of the passive latch mechanism to permit the buckle to be unclasped;

a release mechanism for another latching mechanism actuable through the application of a pinching force on the buckle when clasped; and the release mechanism translating a portion of the pinching force into a separation force to contribute to urging the buckle members away from each other and disengage the passive latch mechanism.

16. The buckle according to claim 15, wherein the separation force applied to urge the buckle members away from each other is greater than a separation force of a buckle without the passive latch mechanism.

17. A child resistant buckle, comprising:

first and second buckle members shaped to be cooperatively joined in a clasped condition;

a first and a second latch mechanism, each including releasably cooperative components on the first and second buckle members respectively, and each arranged to be releasably cooperative when the first and second buckle members are joined in the clasped condition to retain the first and second buckle members together;

the first latch mechanism being arranged to be externally accessible for releasable actuation;

the second latch mechanism being arranged to be internal to the buckle and relatively inaccessible to a user from a location that is external to the buckle, the second latch mechanism being a passive latch mechanism being disengagable through application of a separation force applied to both the first and second buckle members to urge the first and second buckle members away from each other, the cooperative components of the passive latch mechanism being configured to oppose each other in a direction of the separation force to resist the separation force; and the first latch mechanism arranged to prevent the separation force from being transferred to the cooperative components of the passive latch mechanism when the cooperative components of the first latch mechanism are cooperatively engaged.

18. The buckle according to claim 17, further comprising an actuator device arranged to be externally accessible and being operable to disengage the passive latch mechanism.

19. The buckle according to claim 17, further comprising the first and second latch mechanisms being separately and independently actuable.

* * * * *